United States Patent [19]

Takano et al.

[11] Patent Number: 4,917,738

[45] Date of Patent: Apr. 17, 1990

[54] STEAM TURBINE ROTOR FOR HIGH TEMPERATURE

[75] Inventors: Yusaku Takano, Nagasaki; Akio Hizume, Tokyo; Yorimasa Takeda, Nagasaki; Toshio Fujita, Tokyo; Shushi Kinoshita, Akashi; Kikuo Morita, Kakogawa; Masahiro Ikuta, Kakogawa, all of Japan

[73] Assignees: Mitsubishi Jukogyo Kabushiki Kaisha, Tokyo; Kabushiki Kaisha Kobe Seikosho, Kobe, both of Japan

[21] Appl. No.: 201,294

[22] Filed: May 31, 1988

Related U.S. Application Data

[63] Continuation of Ser. No. 880,880, Jul. 1, 1986, abandoned.

[30] Foreign Application Priority Data

Jul. 9, 1985 [JP] Japan ..... 60-149185

[51] Int. Cl.[4] ..... C22C 38/22; C22C 38/24

[52] U.S. Cl. ..... 148/325; 148/335; 148/334; 420/69

[58] Field of Search ..... 148/325, 335, 334, 333; 420/69, 67; 416/241 R

[56] References Cited

U.S. PATENT DOCUMENTS

| | | | |
|---|---|---|---|
| 2,853,410 | 9/1958 | Lula | 420/69 |
| 2,905,577 | 9/1959 | Harris et al. | 148/325 |
| 4,404,041 | 9/1983 | Takahori et al. | 148/325 |
| 4,440,024 | 11/1983 | Siga et al. | 148/325 |
| 4,477,280 | 10/1984 | Shiga et al. | 148/325 |

FOREIGN PATENT DOCUMENTS

| | | | |
|---|---|---|---|
| 58-120764 | 7/1983 | Japan | 148/325 |
| 60-13056 | 1/1985 | Japan | 420/69 |
| 0148819 | 1/1962 | U.S.S.R. | 420/69 |

*Primary Examiner*—Deborah Yee

*Attorney, Agent, or Firm*—Fleit, Jacobson, Cohn, Price, Holman & Stern

[57] ABSTRACT

The present invention is directed to a steam turbine rotor which comprises an iron base alloy containing 0.05 to 0.2 wt % of carbon, 0.1 wt % or less of silicon, 0.05 to 1.5 wt % of manganese, more than 8.0 wt % to less than 13 wt % of chromium, less than 1.5 wt % of nickel, 0.1 to 0.3 wt % of vanadium, 0.01 to 0.1 wt % of niobium, 0.01 to 0.1 wt % of nitrogen, 0.02 wt % or less of aluminum, less than 0.50 wt % of molybdenum and 0.9 to 3.0 wt % of tungsten; contents of molybdenum Mo and tungsten W satisfying the following formulae $$0.75 \leqq \tfrac{1}{2}W + Mo \text{ and}$$

$$3 \leqq W/Mo;$$

a δ-ferrite phase and a large grain boundry carbide being scarcely contained basically in the metallic structure; a matrix of martensite being formed therein.

4 Claims, 1 Drawing Sheet

STEAM TURBINE ROTOR FOR HIGH TEMPERATURE

This application is a continuation of case Ser. No. 06/880,880 file July 1, 1986, now abandoned.

FIELD OF THE INVENTION AND RELATED ART STATEMENT

The present invention relates to a steam turbine rotor for a high temperature used in an extra super critical pressure plant and the like, and its manufacturing method.

In particular, the present invention relates to a rotor suitable for an extra super critical pressure steam turbine under the steam conditions that a pressure is 316 kg/cm$^2$ or more and a temperature is 593° C. or more, the aforesaid rotor having excellent long-time creep rupture strength, notch creep rupture strength, creep rupture elongation and creep rupture area reduction (drawing) as well as good toughness at a high temperature.

Heretofore, the severest steam conditions in a high or intermediate pressure turbine are a pressure being 246 kg/cm$^2$ and a temperature being 538° C., but owing to a steep rise of fuel costs in recent years, it has been attempted that the pressure and the temperature of the steam are raised up to 316 kg/cm$^2$ or more and 593° C. or more so as to enhance the efficiency of the turbine and to thereby save energy.

As materials for the high or intermediate pressure rotor in the conventional large-scale turbine, there have been utilized a so-called Cr-Mo-V steel and a 12% chrominum steel disclosed in, for example, Japanese Patent Publication No. 4137/1965. With regard to the Cr-Mo-V steel, however, its strength in a high temperature is low and a variety of properties cannot be obtained stably, and in consequence, the rotor has been cooled with a low-temperature steam. Therefore, the above mentioned steam conditions which are contemplated of late are beyond the use limit of the Cr-Mo-V steel, with the result that such a steel cannot be applied to the high-temperature rotor thus intended.

On the other hand, with regard to the 12% chromium steel which has been utilized until now, its strength at a high temperature is higher than the Cr-Mo-V steel, but at the above mentioned temperature of 593° C. or more which the steam has, the long-time creep rupture strength will be lowered. It is fair to say that such a high steam temperature exceeds an applicable limit of the 12% chromium steel.

In this connection, other related arts are described in Japanese Patent Provisional Publication Nos. 116858/1981, 120654/1982, 232231/1984 and 116360/1984.

OBJECT AND SUMMARY OF THE INVENTION

In view of such circumstances, a first object of the present invention is to provide a rotor having an excellent long-time creep rupture strength, notch creep rupture strength, creep rupture elongation and creep rupture area reduction even under the above mentioned severe steam conditions.

A second object of the present invention is to provide a rotor excellent in toughness at ordinary temperature as well as strength at a high temperature. Because if the toughness at ordinary temperature is low, the rotor will brittlely fracture at times, when driven in a steam turbine for thermal power generation.

A third object of the present invention is to provide a rotor having a high ductility to prevent the occurrence of cracks due to thermal fatigue. When stop and start of driving the rotor are often repeated in compliance with the change in the demand of electric power in the day time and in the night, thermal stress will take place, so that cracks due to thermal fatigue will appear on occasion. For the purpose of preventing the occurrence of such cracks attributable to the thermal fatigue, it is necessary that the material of the rotor has the high ductility.

A fourth object of the present invention is to provide a rotor excellent in various properties of its central portion in addition to those of its outer portion, particularly long-time creep rupture strength and toughness at ordinary temperature. In the case of the steam turbine the electric power generation the capacity of which is as high as 600 to 1,000 MW, the high or intermediate pressure rotor weighs as much as several tens tons. Accordingly, even if quenching is carried out by the use of an oil or a water spray after a solution heat treatment, a cooling rate in the central portion of the rotor will be only 100° C./hr or so. If hardening is given at such a slow cooling rate, a grain boundary carbide will be deposited during this process, so that the predetermined toughness cannot be obtained at times. For the sake of the present invention, however, a test in which cooling conditions in the central portion of the large rotor were simulated was carried out. According to the present invention, there can be provided, on the basis of this test, the rotor in which the long-time creep rupture strength in the central portion of the large rotor is high and the toughness is very excellent.

A fifth object of the present invention is to provide a rotor which has been subjected to a tempering temperature much higher than a practically used temperature so that its strength may not be lowered remarkably, even when it is employed at a high temperature for a long period of time.

A sixth object of the present invention is to provide a forged rotor weighing as much as several tens tons in which no δ-ferrite is produced. Since the δ-ferrite leads to a remarkable deterioration in fatigue strength in the time of its use at a high temperature, the formation of such a ferrite must be avoided perfectly.

The above mentioned objects of the present invention can be achieved by the following constitutions: That is, the first invention is directed to a steam turbine rotor which comprises an iron base alloy containing 0.05 to 0.2 wt % of carbon, 0.1 wt % or less of silicon, 0.05 to 1.5 wt % of manganese, more than 8.0 wt % to less than 13 wt % of chromium, less than 1.5 wt % of nickel, 0.1 to 0.3 wt % of vanadium, 0.01 to 0.1 wt % of niobium, 0.01 to 0.1 wt % of nitrogen, 0.02 wt % or less of aluminum, less than 0.50 wt % of molybdenum and 0.9 to 3.0 wt % of tungsten; contents of molybdenum Mo and tungsten W satisfying the following formulae $$0.75 \leqq \tfrac{1}{2}W + Mo \text{ and}$$

$$3 \leqq W/Mo;$$

a δ-ferrite phase and a large grain boundary carbide being scarcely contained basically in the metallic structure; a matrix of martensite being formed therein.

The second invention of the present case is directed to a steam turbine rotor in which said iron base alloy of the above mentioned first invention further contains at least one of 0.05 wt % or less of tantalum, 0.05 wt % or less of titanium, 0.01 wt % or less of boron and 0.1 wt % of zirconium.

The third invention of the present case is directed to a method for manufacturing a steam turbine rotor which comprises the steps of melting and refining an alloy material the target composition of which is an iron base alloy containing 0.05 to 0.2 wt % of carbon, 0.1 wt % or less of silicon, 0.05 to 1.5 wt % of manganese, more than 8.0 wt % to less than 13 wt % of chromium, less than 1.5 wt % of nickel, 0.1 to 0.3 wt % of vanadium, 0.01 to 0.1 wt % of niobium, 0.01 to 0.1 wt % of nitrogen, 0.02 wt % or less of aluminum, less than 0.50 wt % of molybdenum and 0.9 to 3.0 wt % of tungsten; contents of molybdenum Mo and tungsten W satisfying the following formulae $$0.75 \leqq \tfrac{1}{2}W + Mo \text{ and}$$

$$3 \leqq W/Mo;$$

carrying out deoxidation by a vacuum carbon deoxidation process; using an electroslag remelting process to obtain a homogeneous clean ingot; subjecting the ingot to hot plastic working at 1,000° to 1,250° C.; accomplishing a solution heat treatment and hardening at 980° to 1,150° C.; and carrying out tempering at 650° to 800° C.

Further, the fourth invention is directed to a method for manufacturing a steam turbine rotor which is characterized by containing at least one of 0.05 wt % or less of tantalum, 0.05 wt % or less of titanium, 0.01 wt % or less of boron and 0.1 wt % or less of zirconium in the iron base alloy of the aforesaid third invention.

DETAILED DESCRIPTION OF THE PREFERRED EMBODIMENTS

Figure 1:
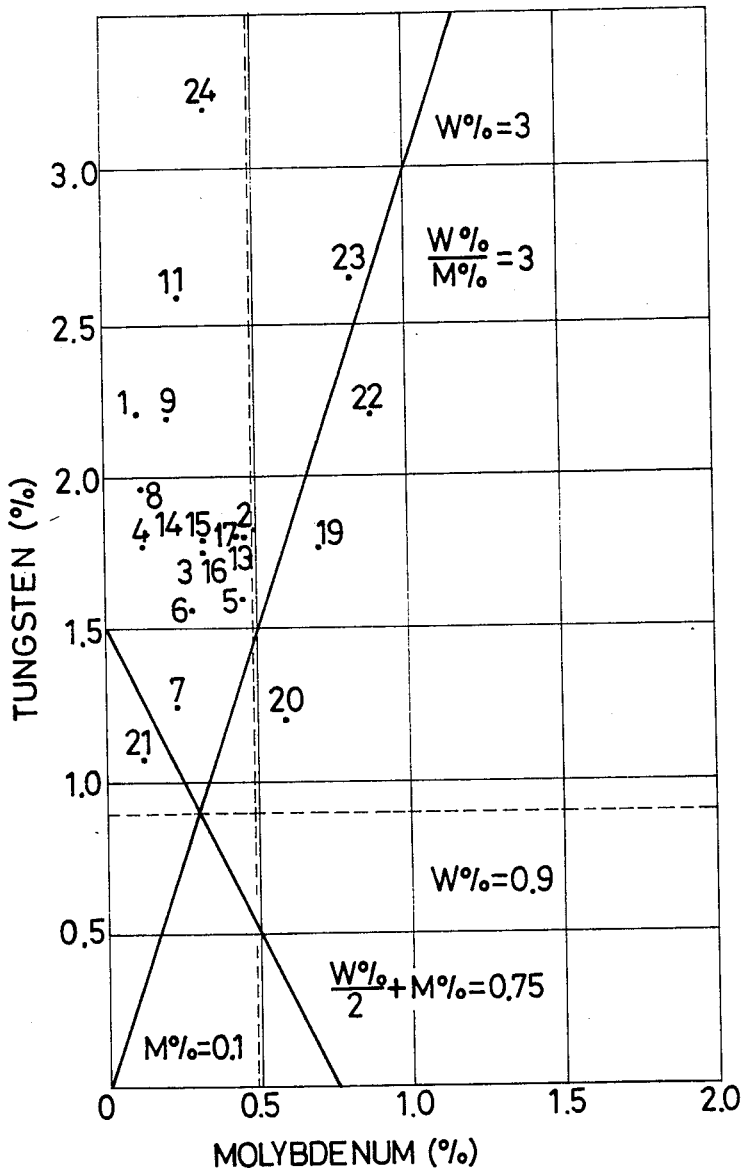
FIG. 1 is a diagram of Mo and W regarding the composition range of an alloy for a steam turbine rotor suitable for a high temperature according to the present invention. The hatched region in the drawing represents the composition range of the alloy according to the present invention. Incidentally, values in the drawing denote the numbers of samples used in examples and comparative examples.

A typical example of manufacturing a rotor according to the present invention is as follows: That is, alloy elements are blended so as to constitute the above mentioned chemical composition, and after melting and refining in an electric furnace, a vacuum carbon deoxidation process (hereinafter referred to as VCD process) is carried out to prepare an ingot having the less content of silicon. Afterward, electroslag remelting (ESR) is preferably accomplished to obtain the homogeneous clean ingot. Then, this ingot is heated at 1,000° to 1,250° C. and is subjected to hot working in order to mold it into a rotor shape, followed by a solution heat treatment at 980° to 1,150° C. Hardening in an oil or in a water spray is then carried out, and tempering is performed at 650° to 800° C. or in two steps of heating at 600° C. or less and an additional heating operation at 650° to 800° C.

Next, the reasons for the restriction on the alloy composition will be described.

(1) Reason why the chromium content is between more than 8.0 wt % and less than 13.0 wt %:

Chromium improves oxidation resistance and corrosion resistance, but when its content is 8.0 wt % or less, the sufficient anticorrosion against a superhigh-temperature steam and the long-time creep rupture strength cannot be acquired; when it is 13.0 wt % or more, a δ-ferrite will be deposited and high-temperature fatigue strength will be lowered.

(2) Reason why the nickel content is less than 1.5 wt %:

Nickel improves the hardening property and the toughness at ordinary temperature and inhibits the production of the δ-ferrite. However, when the amount of nickel to be added is 1.5 wt % or more, the long-time high-temperature creep strength will deteriorate.

(3) Reason why the molybdenum content is less than 0.50 wt % and the tungsten content is between 0.9 wt % or more and to 3.00 wt % less:

The excellent high-temperature creep rupture property of the rotor regarding the present invention is provided by the addition of a great deal of tungsten.

Molybdenum and tungsten both are elements in the VI-b group of the periodic table and behave similarly, when converted into carbides.

Now, since an atomic weight of tungsten is about twice as much as that of molybdenum, the total content of molybdenum and tungsten can be calculated in terms of an equivalent molybdenum content, and the thus calculated value can be regarded as a molybdenum equivalent weight. That is, *molybdenum equivalent* $= \frac{1}{2}$ (*tungsten content*) + (*molybdenum content*)

When the molybdenum content is 0.75 wt % or less, a deposited carbide (Fe, Cr, Mo or W)$_{23}C_6$ (which is in general represented as $M_{23}C_6$) will not be stable in the range of 550° to 650° C., so that the long-time creep rupture strength will decline. On the other hand, when the molybdenum content is 0.50 wt % or more, unstable deposits such as $Fe_2Mo$ and $M_6C$ will be liable to be formed, with the result that the long-time creep rupture strength will fall.

Further, the present invention has one feature that the creep rupture strength at a high temperature, particularly at a temperature of 593° C. or more, is heightened by using a greater amount of tungsten than that of molybdenum, even if the molybdenum equivalent is identical.

Concretely, a W/Mo ratio of (tungsten content)/(molybdenum content) is set at a level of 3 or more with the intention of increasing the creep rupture strength.

This constitution makes use of the fact that tungsten behaves nearly like molybdenum but is more stable than the latter, as understood from that tungsten has a higher melting point than molybdenum.

On the other hand, when the tungsten content is 0.9 wt % or less, the high-temperature strength will be low; when it is in excess of 3 wt %, its toughness will be poor.

To sum up, it is preferred that the molybdenum content is less than 0.50 wt %.

The tungsten content is set so as to be between 0.9 wt % or more and 3 wt % or less, a value of $\frac{1}{2}$(wt % of tungsten) + (wt % of molybdenum) is set at 0.75 wt % or more, and the ratio of (wt % of tungsten)/(wt % of molybdenum) is set at the level of 3.

(4) Reason why the vanadium content is between 0.10 wt % or more and 0.30 wt % or less:

Vanadium produces the carbide VC and the nitride VN in order to strengthen the matrix, and it also fines $M_{23}C_6$ which is deposited during using the rotor at a high temperature, thereby enhancing the long-time creep rupture strength. When the vanadium content is less than 0.10 wt %, the effect of VC and VN will be insufficient, with the result that the creep rupture strength will be low. When vanadium is added in an amount in excess of 0.30 wt %, the carbide will cohere and coarsen after the rotor has been used for a long time, so that the creep rupture strength will be deteriorated.

(5) Reason why the niobium content is between 0.01 wt % or more and 0.10 wt % or less:

Niobium produces the carbide NbC and the nitride NbN, like vanadium, in order to strengthen the matrix and it also fines $M_{23}C_6$ which is deposited during using the rotor at a high temperature, thereby enhancing the long-time creep rupture strength remarkably. When the niobium content is less than 0.01 wt %, its effect will be insufficient, with the result that the sufficient creep rupture strength cannot be obtained. When niobium is added in an amount in excess of 0.10 wt %, NbC will not be dissolved amply at a hardening temperature of 980° to 1,150° C. and the deposited NbC will cohere and coarsen during using the rotor, so that the long-time creep rupture strength will deteriorate.

(6) Reason why the nitrogen content is between 0.01 wt % or more and 0.1 wt % or less:

Nitrogen is an element which is absolutely necessary to ensure various properties of the steel regarding the present invention, especially the creep rupture strength at a high temperature, but when an amount of its addition is in excess of 0.1 wt %, the creep rupture strength at a high temperature will be lowered in a period of $10^4$ to $10^5$ hours, because the resultant nitride will be apt to cohere and coarsen. On the contrary, when the nitrogen content is less than 0.01 wt %, the sufficient creep rupture strength at 550° to 650° C. will not be acquired. In consequence, an optimum nitrogen content ranges from 0.01 wt % or more to 0.1 wt % or less. In addition, the optimum total amount of nitrogen and carbon ranges from 0.13 wt % or more to 0.22 wt % or less.

(7) Reason why the carbon content is between 0.05 wt % or more and 0.20 wt % or less:

Carbon is an element by which the strength at a high pressure and the toughness at ordinary temperature are affected, and when the carbon content is less than 0.05 wt %, any sufficient carbide and any uniform martensite cannot be prepared. That is, in such a case, the mixed structure of a martensite, a bainite and a δ-ferrite will be formed, with the result that the high-temperature strength and the high-temperature fatigue strength will be lowered remarkably. On the contrary, when carbon is added exceeding 0.20 wt %, the toughness at ordinary temperature will deteriorate, and in addition thereto, the carbide will cohere and coarsen noticeably in the time of using the rotor at a temperature of 550° C. or more, so that the long-time creep rupture strength will decline. Further, the optimum total amount of carbon and nitrogen ranges from 0.13 wt % or more to 0.22 wt % or less.

(8) Reason why the silicon content is 0.10 wt % or less:

Heretofore, silicon has often been used as a deoxidizer, but in the case that the steel of the present invention is manufactured by a vacuum carbon deoxidation process and an electroslag remelting process, a killed steel containing a less amount of oxygen can be obtained even when the silicon content is 0.05 wt % or so, and what is better, such a small amount of silicon permits inhibiting segregation even when the large ingot is formed. In addition, any toughness will not decline even after a long-time use of the rotor. When the silicon content is in excess in 0.10 wt %, the segregation will be violent, and after the use of the rotor for a long time, the toughness will deteriorate.

(9) Reason why the manganese content is between 0.05 wt % or more and 1.5 wt % or less:

Manganese has heretofore been used as a deoxidizer in an amount of 0.5 to 0.8 wt % or so, but in the present invention, the satisfactory killed steel can be obtained even in an amount as small as 0.05 wt %, and even after the use of the rotor for a long time, the toughness will not decline. Therefore, the lower limit of the manganese content is set at 0.05 wt %. When the amount of manganese to be added is in excess of 1.5 wt %, it will behave like nickel, and the creep strength will deteriorate.

(10) Reason why the aluminum content is 0.02 wt % or less:

Aluminum is used as a deoxidizer for the steel and as an element for fining crystalline grains, but when it is added in excess of 0.02 wt %, the long-time creep rupture strength will decline remarkably at a temperature of 593° C. or more. Therefore, the aluminum content in the rotor regarding the present invention is set at 0.02 wt % or less.

Additionally, the steel for the rotor regarding the present invention may contain one or more elements of tantalum, titanium, boron and zirconium in a predetermined amount or less. Reasons for the restrictions on these components will be described as follows:

(11) Reason why the tantalum content is 0.05 wt % or less:

Tantalum displays about the same effect as niobium, but when added in excess of 0.05 wt %, tantalum will not be dissolved in the matrix even at a hardening temperature of 1,150° C., so that the sufficient creep rupture strength cannot be acquired. If tantalum is added simultaneously with titanium, the following formula must be satisfied:

$$Nb+\tfrac{1}{2}Ta+2Ti<0.2 \text{ wt } \%$$

Unless this formula is met, the long-time creep rupture strength will decline.

(12) Reason why the titanium content is 0.05 wt % or less:

Titanium forms Ti(C or N) in order to fix nitrogen in the steel, so that the short-time creep rupture strength is slightly lowered, but the long-time creep rupture strength is heightened. When the titanium content exceeds 0.05 wt %, the amount of the dissolved nitrogen in the steel will decrease, and thus the short-time creep rupture strength will decline remarkably. For this reason, the upper limit of the titanium content is set at 0.05 wt %. Needless to say, in the case that titanium is added simultaneously with tantalum, the above mentioned formula must be satisfied.

(13) Reason why the boron content is 0.01 wt % or less:

Boron heightens the creep rupture strength noticeably within the temperature range of 595° to 650° C., but when the boron content is in excess of 0.01 wt %, hot working will be difficult to do. In consequence, the upper limit of the boron content is set at 0.01 wt %.

(14) Reason why the zirconium content is 0.1 wt % or less:

Zirconium is an element for strongly producing a carbide, and it further forms a nitride and an oxide to fix nitrogen and oxygen in the steel, so that the toughness at ordinary temperature is heightened. However, when zirconium is added in excess of 0.1 wt %, an amount of the dissolved nitrogen in the steel will decrease and thus the creep rupture strength will decline.

As described above, the steel of the present invention can be applied to the rotor material of the steam turbine at a high temperature, and it can be additionally utilized for turbine blades used at a high temperature, various bolts used at a high temperature, various rolls, valve rods and valve seats.

EXAMPLE 1

In a 50-kg vacuum smelting furnace, 50 kg of an ingot was manufactured, and this ingot was then subjected to an extend forging treatment in the temperature range of 1,150° to 950° C. in order to obtain a 60 mm×60 mm square bar. The results of chemical analysis of this square bar are set forth in Table 1.

Among the respective samples shown in Table 1, Nos. 1 to 18 are concerned with the present invention, and Nos. 19 to 24 are connected with comparative materials.

A specimen which was cut out from each square bar was subjected to the following heat treatment which the central portion of an actual rotor would undergo:

Solution heat treatment: 1,050° C.×15 hr

Quench hardening rate: about 100° C./hr for a 1,200-mm-diameter simulator of the central portion of the rotor Tempering treatment: furnace cooling of 660° C.×23 hr Table 2 sets forth mechanical properties of these materials, i.e., the results of the tensile test and the 2 mm V-shaped notch Charpy impact test at ordinary temperature.

Every material sufficiently satisfied the 0.2% Yield point and the tensile strength necessary as the turbine rotor.

Further, the results in Table 2 indicate that every material also had the tensile elongation and area reduction which were necessary and enough as the rotor material.

The impact values at ordinary temperature were scattering, but all the samples, except for the No. 24 comparative material containing 3.21 wt % of tungsten, had the impact values necessary as the rotor material. The reason why the tungsten content in the steel of the present invention is limited to 3 wt % or less is that it is needful to prevent the toughness of the steel from declining as in the material of No. 24.

In Table 3, the respective materials are compared with each other in point of the creep rupture strength of 650° C.×$10^4$ hr. The values of these strengths were presumed from stress/time curves at 650° C.

As be definite from Table 3, the Nos. 1 to 18 which were the steels of the present invention had higher creep rupture strengths than the comparative materials of Nos. 19 to 24.

The comparative material No. 24 was also relatively excellent in the creep rupture property, but since the tungsten content therein was in excess of 3%, the toughness was lowered. Therefore, the No. 24 material was not appropriate for the turbine rotor and was thus excluded from the range of the present invention.

The feature of the present invention resides in that the tungsten content is larger than the molybdenum content (i.e., a W/Mo ratio is 3 or more) to heighten the creep rupture strength at a high temperature, and the effect due to such a constitution will be described by comparing the material Nos. 1 to 18 of the present invention with the comparative material Nos. 19 to 23. In this connection, FIG. 1 should be referred to in which the alloy composition according to the present invention is displayed by a graph, paying much attention to Mo and W.

The W/Mo ratio of each material, i.e., (tungsten content)/(molybdenum content) is set forth in Tables 1 and 3.

The materials of the present invention all had values of 3 or more.

On the other hand, it is apparent that comparative material Nos. 19, 20 and 22 the W/Mo ratios of which were 3 or less were poorer in the creep rupture strength as compared with the steels of the present invention.

In order to obtain the rotor material having the excellent high-temperature creep rupture strength which can be used for the extra super critical pressure steam turbine at 593° C. or more, it is confirmed from the above mentioned data that the tungsten content of 3% or less and the W/Mo ratio of 3 or more are successful.

However, for the manufacture of the rotor material excellent in the high-temperature creep rupture strength, the total amount of tungsten and molybdenum must be regulated in addition to the restriction on the ratio of tungsten to molybdenum. This fact will be described comparing Nos. 7 and 11 which were the materials of the present invention with comparative material Nos. 21 and 23 in Table 3. It will also be helpful to refer to FIG. 1.

The molybdenum equivalent, i.e., [(percentage of tungsten)/2]+(percentage of molybdenum), of the comparative material No. 21 was 0.66%, and that of No. 23 was 2.16%.

On the other hand, with regard to the molybdenum equivalent of the materials regarding the present invention, No. 7 had the lowest value of 0.86%, and No. 11 had the highest value of 1.52%.

Nos. 7 and 11 had the lower creep rupture strengths among the materials of the present invention, but they could maintain higher strength levels than comparative materials Nos. 21 and 23.

From the above given description, it is apparent that for the manufacture of the rotor having the excellent high-temperature creep rupture strength, the molybdenum equivalent of 1.20% is successful.

In the first invention of the present application, it is determined from these data that the contents of tungsten and molybdenum which are the sources for the high-temperature strength of the 12% chromium rotor material should be within the hatched range in FIG. 1.

Nos. 13 to 18 in the example were the materials regarding the second invention of the present application in which tantalum, titanium, boron and zirconium were added to the composition of the above mentioned first invention, but it is understood from the data in Tables 2 and 3 that Nos. 13 to 18 were excellent in all of the tensile strength, the tensile ductility, the toughness and the creep rupture strength. With regard to the restricted ranges regarding the amounts of tantalum, titanium, boron and zirconium, and with regard to the reasons for such restrictions, they have already been described.

TABLE 1

| Sample No. | C | Si | Mn | P | S | Cr | Ni | Mo | W | V | Nb |
|---|---|---|---|---|---|---|---|---|---|---|---|
| | Chemical Composition (wt % of elements) | | | | | | | | | | |
| 1 | 0.12 | 0.05 | 0.50 | 0.003 | 0.001 | 11.27 | 0.81 | 0.10 | 2.21 | 0.21 | 0.048 |
| 2 | 0.14 | 0.03 | 0.50 | 0.0025 | 0.002 | 9.82 | 0.70 | 0.49 | 1.84 | 0.18 | 0.053 |
| 3 | 0.13 | 0.02 | 0.51 | 0.007 | 0.004 | 10.12 | 0.70 | 0.31 | 1.78 | 0.16 | 0.053 |
| 4 | 0.14 | 0.02 | 0.52 | 0.007 | 0.005 | 10.20 | 0.69 | 0.11 | 1.78 | 0.17 | 0.057 |
| 5 | 0.16 | 0.06 | 0.47 | 0.001 | 0.003 | 10.17 | 0.64 | 0.45 | 1.61 | 0.16 | 0.048 |
| 6 | 0.15 | 0.03 | 0.52 | 0.003 | 0.005 | 10.02 | 0.65 | 0.28 | 1.58 | 0.18 | 0.052 |
| 7 | 0.09 | 0.04 | 0.45 | 0.006 | 0.003 | 9.23 | 0.52 | 0.23 | 1.26 | 0.15 | 0.050 |
| 8 | 0.14 | 0.02 | 0.51 | 0.008 | 0.005 | 10.23 | 0.69 | 0.11 | 1.96 | 0.17 | 0.058 |
| 9 | 0.13 | 0.058 | 0.49 | 0.002 | 0.002 | 10.15 | 0.70 | 0.18 | 2.19 | 0.18 | 0.053 |
| 10 | 0.12 | 0.05 | 0.50 | 0.003 | 0.001 | 11.5 | 0.80 | — | 2.30 | 0.20 | 0.049 |
| 11 | 0.17 | 0.02 | 0.50 | 0.002 | 0.003 | 10.16 | 0.69 | 0.22 | 2.59 | 0.17 | 0.045 |
| 13 | 0.15 | 0.06 | 0.45 | 0.004 | 0.002 | 10.10 | 0.65 | 0.45 | 1.82 | 0.17 | 0.012 |
| 14 | 0.15 | 0.05 | 0.51 | 0.003 | 0.004 | 10.50 | 0.70 | 0.32 | 1.81 | 0.18 | 0.045 |
| 15 | 0.14 | 0.03 | 0.51 | 0.004 | 0.005 | 10.30 | 0.68 | 0.32 | 1.82 | 0.17 | 0.045 |
| 16 | 0.12 | 0.06 | 0.49 | 0.005 | 0.002 | 10.21 | 0.70 | 0.31 | 1.78 | 0.18 | 0.047 |
| 17 | 0.13 | 0.05 | 0.51 | 0.005 | 0.004 | 10.92 | 1.12 | 0.42 | 1.82 | 0.16 | 0.025 |
| 18 | 0.12 | 0.04 | 0.45 | 0.007 | 0.006 | 10.30 | 0.62 | 0.48 | 1.78 | 0.17 | 0.051 |
| 19 | 0.13 | 0.08 | 0.46 | 0.002 | 0.002 | 10.09 | 0.70 | 0.69 | 1.79 | 0.18 | 0.051 |
| 20 | 0.15 | 0.04 | 0.53 | 0.009 | 0.005 | 10.16 | 0.68. | 0.58 | 1.22 | 0.15 | 0.055 |
| 21 | 0.14 | 0.02 | 0.45 | 0.005 | 0.002 | 10.20 | 0.70 | 0.12 | 1.09 | 0.16 | 0.045 |
| 22 | 0.15 | 0.03 | 0.46 | 0.002 | 0.005 | 10.17 | 0.68 | 0.86 | 2.21 | 0.17 | 0.045 |
| 23 | 0.15 | 0.06 | 0.52 | 0.001 | 0.002 | 10.16 | 0.66 | 0.82 | 2.68 | 0.16 | 0.051 |
| 24 | 0.12 | 0.05 | 0.44 | 0.008 | 0.003 | 10.20 | 0.71 | 0.31 | 3.21 | 0.15 | 0.052 |

| Sample No. | N | Al | Ta | Ti | B | Zr | Fe | W %/Mo % | W %/2 + Mo % (%) |
|---|---|---|---|---|---|---|---|---|---|
| 1 | 0.056 | 0.002 | — | — | — | — | Residue | 22.1 | 1.21 |
| 2 | 0.046 | 0.002 | — | — | — | — | " | 3.8 | 1.41 |
| 3 | 0.038 | 0.005 | — | — | — | — | " | 5.7 | 1.20 |
| 4 | 0.037 | 0.006 | — | — | — | — | " | 16.1 | 1.00 |
| 5 | 0.051 | 0.003 | — | — | — | — | " | 3.6 | 1.26 |
| 6 | 0.045 | 0.005 | — | — | — | — | " | 5.6 | 1.07 |
| 7 | 0.067 | 0.003 | — | — | — | — | " | 5.5 | 0.86 |
| 8 | 0.037 | 0.006 | — | — | — | — | " | 17.8 | 1.09 |
| 9 | 0.055 | 0.007 | — | — | — | — | " | 12.2 | 1.28 |
| 10 | 0.057 | 0.002 | — | — | — | — | " | ∞ | 1.15 |
| 11 | 0.035 | 0.002 | — | — | — | — | " | 11.8 | 1.52 |
| 13 | 0.054 | 0.002 | 0.045 | — | — | — | " | 4.0 | 1.36 |
| 14 | 0.048 | 0.003 | — | 0.02 | — | — | " | 5.6 | 1.22 |
| 15 | 0.046 | 0.003 | — | — | 0.005 | — | " | 5.7 | 1.23 |
| 16 | 0.051 | 0.005 | — | — | — | 0.02 | " | 5.7 | 1.20 |
| 17 | 0.055 | 0.005 | 0.031 | — | 0.003 | — | — | 4.3 | 1.33 |
| 18 | 0.044 | 0.003 | — | 0.01 | — | 0.02 | — | 3.7 | 1.37 |
| 19 | 0.042 | 0.002 | — | — | — | — | Residue | 2.6 | 1.58 |
| 20 | 0.042 | 0.005 | — | — | — | — | " | 2.1 | 1.19 |
| 21 | 0.041 | 0.003 | — | — | — | — | " | 9.0 | 0.66 |
| 22 | 0.052 | 0.004 | — | — | — | — | " | 2.6 | 1.96 |
| 23 | 0.047 | 0.005 | — | — | — | — | " | 3.3 | 2.16 |
| 24 | 0.065 | 0.003 | — | — | — | — | " | 10.4 | 1.92 |

TABLE 2

| Sample No. | 0.2% Yeild Point (kg/mm²) | Tensile Strength (kg/mm²) | Elongation (%) | Area Reduction (%) | 2 mm V-Notch Charpy Impact Value (kg-m) |
|---|---|---|---|---|---|
| | Tensile Test | | | | |
| 1 | 78.0 | 91.0 | 22.0 | 63.0 | 12.0 |
| 2 | 79.6 | 93.0 | 22.2 | 64.4 | 7.8 |
| 3 | 77.5 | 90.7 | 22.8 | 65.5 | 21.8 |
| 4 | 77.1 | 90.6 | 24.0 | 67.3 | 7.1 |
| 5 | 71.2 | 87.3 | 22.4 | 65.7 | 19.0 |
| 6 | 72.6 | 86.3 | 24.0 | 58.7 | 19.2 |
| 7 | 70.0 | 85.2 | 25.2 | 68.1 | 20.5 |
| 8 | 76.1 | 89.6 | 24.0 | 67.5 | 22.8 |
| 9 | 80.7 | 93.6 | 22.6 | 65.7 | 8.0 |
| 10 | 78.0 | 92.1 | 22.2 | 62.8 | 12.0 |
| 11 | 81.2 | 93.5 | 23.2 | 61.7 | 5.1 |
| 13 | 76.0 | 89.7 | 22.9 | 68.4 | 20.1 |
| 14 | 77.8 | 90.3 | 23.2 | 61.2 | 19.5 |
| 15 | 78.7 | 91.3 | 22.5 | 61.6 | 18.5 |
| 16 | 75.4 | 89.6 | 21.8 | 68.1 | 9.4 |
| 17 | 76.2 | 90.3 | 22.1 | 60.5 | 18.3 |
| 18 | 77.3 | 91.6 | 21.6 | 59.4 | 16.5 |

TABLE 2-continued

| Sample No. | 0.2% Yeild Point (kg/mm²) | Tensile Strength (kg/mm²) | Elongation (%) | Area Reduction (%) | 2 mm V-Notch Charpy Impact Value (kg-m) |
|---|---|---|---|---|---|
| | Tensile Test | | | | |
| 19 | 81.1 | 93.8 | 22.8 | 65.8 | 4.7 |
| 20 | 76.3 | 90.5 | 24.4 | 67.9 | 21.8 |
| 21 | 71.2 | 86.5 | 23.2 | 70.2 | 20.5 |
| 22 | 81.2 | 93.6 | 23.4 | 69.5 | 7.6 |
| 23 | 83.3 | 94.9 | 21.3 | 65.3 | 4.5 |
| 24 | 82.2 | 94.3 | 22.4 | 61.9 | 1.8 |

TABLE 3

| Sample No. | 650° C. × 10⁴ hr Creep Rupture Strength (kg/mm2)* | W/Mo Ratio (W %/Mo %) | Molybdenum Equivalent (W %/2 + Mo %) (%) |
|---|---|---|---|
| 1 | 14.0 | 22.1 | 1.21 |
| 2 | 10.5 | 3.8 | 1.41 |
| 3 | 11.6 | 5.7 | 1.20 |
| 4 | 11.4 | 16.1 | 1.00 |
| 5 | 10.5 | 3.6 | 1.26 |

TABLE 3-continued

| Sample No. | 650° C. × $10^4$ hr Creep Rupture Strength (kg/mm2)* | W/Mo Ratio (W %/Mo %) | Molybdenum Equivalent (W %/2 + Mo %) (%) |
|---|---|---|---|
| 6 | 9.9 | 5.6 | 1.07 |
| 7 | 9.6 | 5.5 | 0.86 |
| 8 | 10.9 | 17.8 | 1.09 |
| 9 | 10.8 | 12.2 | 1.28 |
| 10 | 14.0 | ∞ | 1.15 |
| 11 | 10.2 | 11.8 | 1.52 |
| 13 | 10.7 | 4.0 | 1.36 |
| 14 | 10.5 | 5.6 | 1.22 |
| 15 | 10.4 | 5.7 | 1.23 |
| 16 | 10.7 | 5.7 | 1.20 |
| 17 | 10.8 | 4.3 | 1.33 |
| 18 | 11.0 | 3.7 | 1.37 |
| 19 | 9.2 | 2.6 | 1.58 |
| 20 | 8.4 | 2.1 | 1.19 |
| 21 | 8.3 | 9.0 | 0.66 |
| 22 | 9.1 | 2.6 | 1.96 |
| 23 | 9.3 | 3.3 | 2.16 |
| 24 | 9.8 | 10.4 | 1.92 |

*values presumed from stress/time diagrams

EXAMPLE 2

In manufacturing a 12% chromium rotor, an ingot was made by a method comprising an electric furnace refining process and then a vacuum carbon deoxidation process, or alternatively by a method of subjecting the thus made primary ingot to an electroslag remelting (ESR) process in order to prepare a homogeneous clean secondary ingot. In the latter method, it is taken into consideration that the reduction in the segregation in the central portion of the ingot is important in the manufacture of the 12% chromium rotor.

Thus, two large ESR materials (2 tons) of the present invention were prepared, and a property confirmation test was carried out. The chemical components of the samples are set forth in Table 4.

The manufacturing procedure was as follows:

Firstly, the electric furnace refining process and then the vacuum carbon deoxidation process were accomplished to prepare the primary ingot having the low silicon content, and an electrode for the electroslag remelting was made by the use of the thus prepared ingot.

Then, this electrode was subjected to the electroslag remelting treatment, so that the secondary ingot weighing 2 tons was manufactured. Afterward, this ingot was hot-forged to form a round bar having a diameter of 380 mm. A forging ratio in this time was set at a value corresponding to a forging ratio of a real large rotor.

Afterward, this round bar was subjected to a preliminary heat treatment (isothermal transformation treatment) as in the case of the large rotor, and the following final heat treatment was then carried out:

Solution heat treatment: 1,050° C.×23 hr

Quench hardening rate: about 100° C./hr for a 1,200-mm-diameter simulator of the central portion of the rotor Tempering treatment: Air cooling of 550° C.×20 hr and Air cooling of 680° C.×23 hr The first tempering treatment of the 550° C.×20 hr air cooling just mentioned was carried out with the aim of converting an austenite structure, which might remain after the previous hardening treatment process, into a martensite structure, and such a first tempering treatment is an ordinary means for the large 12% chromium material.

For the thus forged steel material (2 tons) of the present invention, a variety of property tests were carried out. The results are as follows.

According to the results of the structure inspection by the use of a microscope, a δ-ferrite was not present at all by which high-temperature fatigue strength would be lowered. Further, any grain boundary carbide was not seen, either. It was confirmed that the material of the present invention had an enough hardening property which would withstand the moderate hardening rate for the large rotor. It was sure that the whole structure of the steel regarding the present invention was composed of a good tempered martensite.

Table 5 shows the results of a tensile test and a 2 mm V-notch Charpy impact test at ordinary temperature. From these results, it has been found that the steels of the present invention had the tensile strength, the tensile ductility and the toughness which were sufficient as the steam turbine rotor. In consequence, it can be definite that the steels of the present invention have properties enough to prevent a rapid breakage in the central portion of the rotor which was most fearful.

Table 6 shows the creep rupture strength of 650° C.×$10^4$ hr. It is apparent from Table 6 that the steels of the present invention had the creep rupture strength enough as the steam turbine rotor for a high temperature of 593° C. or more which was used in an extra super critical pressure plant.

Further, Table 7 shows the elongation and the area reduction of the specimens at the time when the latter were creep-ruptured at a temperature of 600° to 650° C. for 400 to 1,000 hours or so. In general, with regard to the steam turbine rotor used at a high temperature, it is considered that the creep ductility of the creep rupture elongation being 10% or more is necessary, but since the material of the present invention has the sufficiently great creep rupture elongation and area reduction, the deterioration in notch creep rupture strength is not anxious any more which accompanies the decline of the creep ductility and which will be a cause of the breakage of the steam turbine rotor used at a high temperature.

TABLE 4

| Sample No. | C | Si | Mn | P | S | Cr | Ni | Mo | W | V | Nb |
|---|---|---|---|---|---|---|---|---|---|---|---|
| | Chemical Composition (wt % of elements) | | | | | | | | | | |
| TM4-1 | 0.12 | 0.05 | 0.46 | 0.007 | 0.003 | 10.2 | 0.8 | 0.30 | 2.20 | 0.18 | 0.045 |
| TM4-2 | 0.13 | 0.06 | 0.52 | 0.008 | 0.002 | 10.3 | 0.7 | 0.38 | 1.81 | 0.17 | 0.052 |

| Sample No. | N | Al | Ta | Ti | B | Zr | Fe | W %/Mo % | W %/2 + Mo % (%) |
|---|---|---|---|---|---|---|---|---|---|
| TM4-1 | 0.045 | 0.005 | — | — | — | — | Residue | 7.3 | 1.40 |
| TM4-2 | 0.051 | 0.004 | — | — | — | — | " | 4.8 | 1.28 |

TABLE

| Sample No. | Tensile Test 0.2% Yield Point ($kg/mm^2$) | Tensile Strength ($kg/mm^2$) | Elongation (%) | Area Reduction (%) | 2 mm V-Notch Charpy Impact Value (kg/m) |
|---|---|---|---|---|---|
| TM4-1 | 77.5 | 92.1 | 19.8 | 54.2 | 4.2 |
| TM4-2 | 73.5 | 89.6 | 20.3 | 57.8 | 6.3 |

TABLE 6

| Sample | Creep Rupture Strength of 650° C. × $10^4$ hr ($kg/mm^2$)* |
|---|---|
| TM 4-1 | 11.2 |
| TM 4-2 | 10.6 |

*values presumed from stress/time diagrams

TABLE 7

| Sample | Test Temperature (°C.) | Stress ($kg/mm^2$) | Rupture Time (hr) | Elongation (%) | Area Reduction (%) |
|---|---|---|---|---|---|
| TM 4-1 | 600 | 25.0 | 752 | 25.1 | 87.7 |
| | 650 | 14.0 | 939 | 24.8 | 88.0 |
| TM 4-2 | 600 | 23.7 | 536 | 29.6 | 84.8 |
| | 650 | 14.0 | 904 | 22.3 | 80.2 |

What is claimed is:

1. A steam turbine rotor which comprises an iron base alloy containing 0.05 to 0.2 wt % of carbon, 0.1 wt % or less of silicon, 0.05 to 1.5 wt % of manganese, more than 8.0 wt % to less than 13 wt % of chromium, less than 1.5 wt % of nickel, 0.1 to 0.21 wt % of vanadium, 0.01 to 0.1 wt % of niobium, 0.01 to 0.1 wt % of nitrogen, 0.02 wt % or less of aluminum, 0.10–0.38 wt % of molybdenum and 0.9 to 3.0 wt % of tungsten; contents of molybdenum Mo and tungsten W satisfying the following formulae $$0.75 \leqq \tfrac{1}{2}W + Mo \text{ and}$$

$$3 \leqq W/Mo$$

a δ-ferrite phase and a large grain boundary carbide being scarcely contained basically in the metallic structure; a matrix of martensite being formed therein.

2. A steam turbine rotor according to claim 1 wherein said iron base alloy further contains at least one of 0.05 wt % or less of tantalum, 0.05 wt % or less of titanium, 0.01 wt % or less of boron and 0.1 wt % of zirconium.

3. A steam turbine rotor according to claim 2 wherein when tantalum and titanium are added simultaneously in manufacturing said iron base alloy, contents of niobium Nb, tantalum Ta and titanium Ti satisfy the following formula $$Nb + \tfrac{1}{2}Ti < 0.2.$$

4. The turbine rotor of claim 1 wherein the nickel content is in the range of 0.6 to 1.0 wt %.

* * * * *